United States Patent [19]

Frei

[11] Patent Number: 4,538,439

[45] **Date of Patent: * Sep. 3, 1985**

[54] CANS FORMED OF THIN-WALLED MATERIAL AND APPARATUS FOR FORMING PRECISE FINE BEADS THEREIN

[75] Inventor: Siegfried Frei, St. Gallen, Switzerland

[73] Assignee: Cantec, Incorporated, Fort Worth, Tex.

[ * ] Notice: The portion of the term of this patent subsequent to Dec. 11, 2001 has been disclaimed.

[21] Appl. No.: 483,652

[22] Filed: Apr. 11, 1983

[30] Foreign Application Priority Data

May 10, 1982 [CH] Switzerland ..... 2884/82
Feb. 18, 1983 [CH] Switzerland ..... 926/83

[51] Int. Cl.[3] ..... B21D 51/26
[52] U.S. Cl. ..... 72/105; 220/72
[58] Field of Search ..... 72/82, 102, 105; 220/72; 29/117, 124

[56] References Cited

U.S. PATENT DOCUMENTS

| | | | |
|---|---|---|---|
| 2,015,086 | 9/1935 | Paynter et al. | 29/124 |
| 3,335,902 | 8/1967 | Javorik | 220/72 |
| 3,495,736 | 2/1970 | Ragettli | 220/72 |
| 3,648,884 | 3/1972 | Mansolino | 220/72 |

FOREIGN PATENT DOCUMENTS

| | | | |
|---|---|---|---|
| 482190 | 3/1977 | Australia | 220/72 |
| 1191951 | 10/1959 | France | 220/72 |

*Primary Examiner*—Lowell A. Larson
*Attorney, Agent, or Firm*—Werner W. Kleeman

[57] ABSTRACT

A can fabricated from sheet material or stock of small thickness contains a can body comprising closely adjacently situated circumferential beads of high precision and mutual parallelism which impart high strength to the can body in both axial direction and radial direction.

An apparatus for forming precision beads on cans formed of sheet material or stock comprises two cylinders rolling-off upon one another and provided with ribs. The cylinder, forming the inner tool, is provided with recesses or gaps in the ribs which are positioned vertically above one another to form axially parallel beads.

7 Claims, 9 Drawing Figures

CANS FORMED OF THIN-WALLED MATERIAL AND APPARATUS FOR FORMING PRECISE FINE BEADS THEREIN

CROSS-REFERENCE TO RELATED APPLICATIONS

This application is related to (i) the commonly assigned, copending U.S. application Ser. No. 06/374,146 filed May 3, 1982, entitled "CANS FORMED OF THIN-WALLED MATERIAL AND METHOD OF FABRICATING THE SAME"; and (ii) the commonly assigned, copending U.S. application Ser. No. 06/374,147, filed May 3, 1982, now U.S. Pat. No. 4,487,048, granted Dec. 11, 1984, and entitled "METHOD AND APPARATUS FOR BEADING THE BODIES OF SHEET METAL CANS".

BACKGROUND OF THE INVENTION

The present invention relates to a new and improved construction of containers or receptacles, hereinafter broadly referred to as cans formed of thin-walled material, particularly of sheet steel or sheet aluminum and comprising a can body containing beads formed therein. The present invention also relates to a new and improved construction of apparatus for producing fine precision beads in thin-walled cans or the like fabricated from sheet material or plating.

It is known to form circumferential beads in the body of cans, particularly thin-walled cans formed from sheet material.

The beads serve to increase the strength of the can in axial and/or in radial direction. Circumferential beads increase the collapse strength when the cans are evacuated or are subjected to cooking processes in an autoclave. Such circumferential beads are presently extensively applied to foodstuff-containing cans.

In containers, particularly large size containers having a volume of 200 liters as known, for example, from British Pat. No. 973,373 and British Pat. No. 978,982, the circumferential beads extend at an inclination relative to the horizontal or along a helical line. Such circumferential beads result in satisfactory strength of the cans in respect of their collapse, however, the axial strength thereof is reduced to an intolerable extent by virtue of the deformation of the can body. Thus it will occur with increasing frequency that containers or cans of such construction when stacked to large heights in a store or other location may fold or buckle under the load of the overlying cans. Thus entire stacks of such containers or cans, which may extend to a height of several meters, can tumble.

In another state-of-the-art container as known, for example, from German Utility Model No. 8,024,406, horizontally positioned assemblies or groups of beads have therefore been suggested and between which there are located planar, non-deformed wall areas which are supposed to contribute to an increase in the axial strength.

Furthermore, in another container construction having circumferential beads as taught, for example, by German Patent Publication No. 3,001,787 there are provided short, vertically extending bead sections which are arranged in juxtaposition, however, offset from each other and which interrupt the circumferential beads.

Another container design as known, for example, from Belgian Pat. No. 411,724, only has a small number of horizontal beads which are spaced far from each other and which are strongly embossed and vertical beads which are likewise spaced far from each other but which are less strongly embossed. Planar, non-deformed body areas or regions are located between the vertical and horizontal beads.

While the axial strength may be actually increased by means of the vertically positioned beads or bead sections, such increase, however, is gained at the expense of the collapse strength.

SUMMARY OF THE INVENTION

Therefore, with the foregoing in mind it is a primary object of the present invention to provide a new and improved can or the like formed of thin-walled material comprising a body with beads formed therein, in which the strength in axial as well as in radial direction is substantially increased in comparison to known constructions of cans.

Another important object of the present invention is directed to the provision of a new and improved construction of can or the like formed of thin-walled material comprising a body with beads formed therein which permits the use of thinner sheet material stock, in particular doubly-reduced sheet metal or plating as well as sheet aluminum.

A further significant object of the present invention is directed to the provision of a new and improved construction of an apparatus for producing fine precision beads in thin-walled cans or the like made of sheet material or stock and having high strength in both axial and radial direction.

Now in order to implement these and still further objects of the invention, which will become more readily apparent as the description proceeds, the can of the present development is manifested by the features that, uninterrupted circumferentially extending fine precision beads are formed in the can body and a number of substantially axially extending beads are superimposed on the circumferential beads and have a smaller depth than the circumferential beads. The axial beads flow into the circumferential beads and extend over the entire bead area or region of the can body.

The apparatus of the present development is manifested by the features that, circumferential ribs extending in parallelism to each other are provided on an inner tool and on an outer tool of the apparatus, the ribs on the outer tool engage into the intermediate spaces between the ribs on the inner tool, and the ribs on at least one of the tools have interruptions arranged axially in parallel one above the other at one or more locations in the ribs of the inner and/or the outer tool.

The circumferential beads are structured to be substantially finer and are arranged at a smaller mutual distance as compared to those of the prior art heretofore known; in particular, the beads are absolutely precisely designed and extend in parallelism over the entire circumference. Consequently, the beads impart axial strength to the can which far exceeds the heretofore known values of axial strength. With such design of the beads the collapse strength is not lower than that provided by the known bead designs but is, actually, exceeded. An additional axial strength will result by virtue of the fact that some axial beads extend gently through the horizontal beads.

A further increase in strength is achieved by the provision of beads which extend along helical lines, elliptic lines or wavy or undulated lines.

The extremely fine beads permit the processing, and thus, the use of cheaper doubly-reduced sheet material or plating which, as is known, is substantially harder than singly reduced sheet material or stock. Also, sheet aluminum of small thickness may be employed for the cans or the like.

The use of doubly-reduced sheet materials or stock also enables the use of thinner sheet material and having the same strength.

A further advantage achieved by the invention resides in the fact that the ends of the beads extending along a helical line continue without any steps or pronounced transitions into the non-deformed area of the can body. Thus weak spots are eliminated which may serve as a starting point for folds or the occurrence of buckling.

By having the ends of the beads alternatingly extend to different extents into the non-deformed areas or regions the strength can be additionally increased.

A further advantage realized with the invention is that the can body will remain perfectly round when the beads are produced by the apparatus described hereinafter in which the can body is non-rotatably clamped by the respective tools relative thereto. Consequently, the lines of force within the can body of the closed can later will be uniformly distributed.

It is a further advantage of the invention that the mutual distance or spacing of the beads as well as their depth will become respectively smaller and/or greater in the direction towards the center of the can body or, respectively, wider and/or less deep in the direction towards the exterior, i.e. towards the base or towards the cover. Thus an additional reinforcement is obtained at this region which is most endangered by pressure.

The tools which roll-off upon each other precisely and synchronously form absolutely precisely embossed reproducible fine beads of highest mutual parallelism at the can body which is held by the inner tool of the apparatus non-rotatably relative to such inner tool. This will result in an absolutely uniform extent or pattern of the axial and radial forces over the entire circumference of the can body. Thus, weak spots are eliminated at which otherwise folds or kinks can start.

Additionally, the axially parallel beads increase the axial strength without affecting the collapse strength.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE DRAWINGS

Describing now the drawings, it is to be understood that only enough of the construction of the can or the like and the apparatus for producing the contemplated beads on the can have been shown as needed for those skilled in the art to readily understand the underlying principles and concepts of the present development, while simplifying the showing of the drawings. Also, throughout the disclosure and claims the term "can" is used in its broadest permissible sense to cover not only cans as such, but other types of containers, receptacles, vessels or canisters and the like, which can be produced in accordance with the teachings of the invention.

Figure 1:
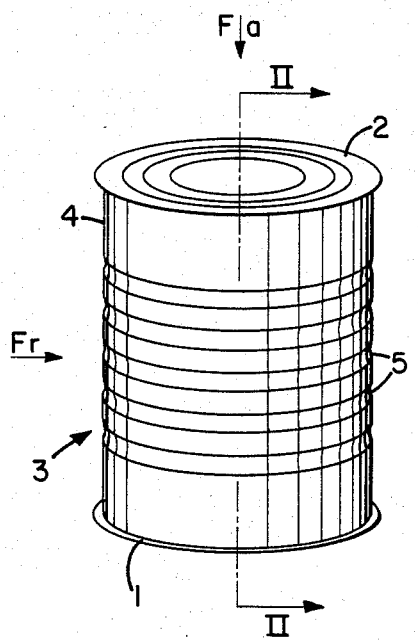
FIG. 1 PRIOR ART
FIG. 1 is an illustration in perspective view of a can body comprising circumferential beads and constructed according to the prior art.

Turning attention now specifically to FIG. 1, there has been schematically illustrated therein in perspective view a prior art construction of can comprising a circular base or bottom 1 and a cover or top 2 made of sheet metal or stock which are placed at or upon a circular cylindrical can body 4 and fastened thereto in conventional manner. The can body 4 is also made of sheet metal or stock, and there results a can 3 formed of sheet material or plating. The can body 4 must accommodate forces $F_r$ directed radially inwardly or outwardly and which particularly occur during and/or after a cooking process in the case of food cans, and furthermore, has to accommodate the force $F_a$ acting in axial direction during storage of such cans 3. To that end circumferential beads 5 which extend normally or perpendicularly with respect to the cylinder axis of the can 3 are provided at the can body 4, see FIG. 1.

The conventional design of sheet metal can 3 may comprise a coherent or continuous assembly of bead groups formed at the central region of the can body 4; the beads may also be divided to form a number of groups of beads. The can body 4 may be fabricated by welding, soldering, deep-drawing or rolling.

Figure 2:
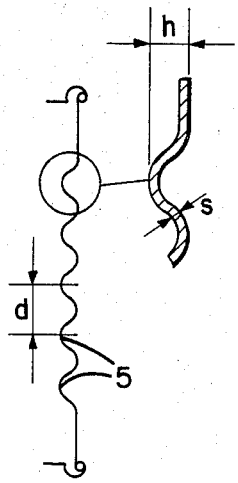
FIG. 2 PRIOR ART
FIG. 2 is a sectional view taken along the line II—II in FIG. 1 and shows a part thereof on an enlarged scale.

The course and the design of these conventional beads 5 will be evident from the longitudinal section through the can body 4 as shown in FIG. 2. The distance or spacing d between the individual beads 5 is very large in comparison to the depth h thereof. Usually the distance d is at least 4.0 mm and the depth h at least 0.7 mm in the case of a can having a diameter of 73 mm and a sheet metal thickness s of 0.19 mm. The flanks between the base and the apex of the beads extend essentially straight or linearly and form inclined planes. Frequently, also, the parallelism of the beads along the circumference is not constant. Thus, different radii are present in one and the same bead which results in reduced strength.

Figure 3:
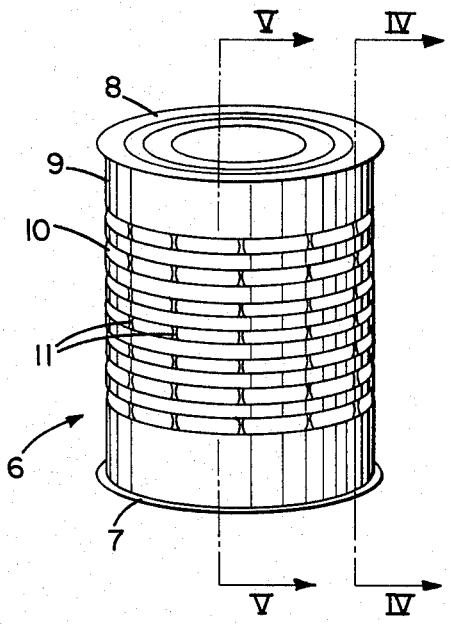
FIG. 3 is an illustration in perspective view of a can body containing schematically represented circumferential horizontal precision beads and vertical beads.
Figure 4:
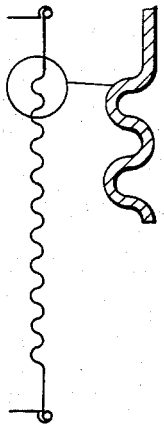
FIG. 4 is a sectional view taken along the line IV—IV in FIG. 3 and illustrating a part thereof on an enlarged scale.
Figure 5:
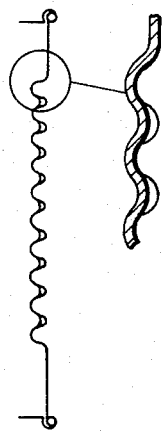
FIG. 5 is a sectional view taken along the line V—V in FIG. 3 and illustrating a part thereof on an enlarged scale.

FIGS. 3 to 5 shows a can 6 containing a base or bottom 7 and a cover or top 8 and which can is fabricated in conventional manner. At the central region of the can body 9 very fine, highly precise beads 10 are embossed. The radii of the beads are the same at the apex and at the base of the beads and the mutual distance or spacing of the beads from one another is absolutely constant over the entire circumference.

Vertical beads 11 extending substantially parallel to the lengthwise axis of the can 6 are superimposed on the beads 10 and are uniformly distributed over the circumference. The vertical or axially extending beads 11 leave unaffected the apex of the beads 10, however, partially reduce the depth of the bead base by 20% to 50% of the depth h of the circumferential beads 10. The axial beads 11 extend through the entire area which is provided with beads.

Figure 6:
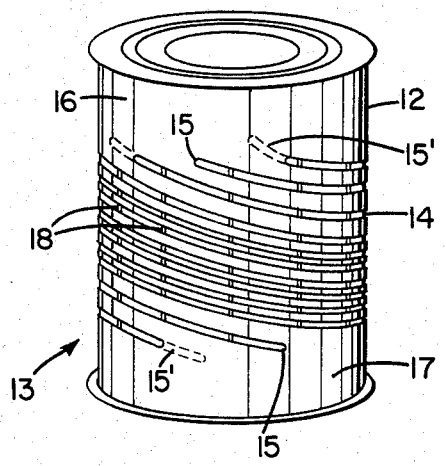
FIG. 6 is an illustration in perspective view of a can body constructed according to the invention comprising precision beads extending along a helical line and fine vertical beads.

FIG. 6 shows a can 13 having beads with an analogous cross-section. Here, the beads 14 are formed in the can body 12 of the can 13 so as to extend along helical lines in a multiple thread arrangement in the illustrated embodiment. The ends 15 of the beads 14 extend continuously and without the formation of an edge-like or stepped transition into the non-deformed areas 16 and 17 of the can body 12. At the central range of the can body 12 three further beads 14 are indicated by dash-dotted lines. It may be of advantage to design the beads at the central range so as to be situated closer to each other and/or to have a slightly greater depth. Also in this embodiment vertical beads 18 are superimposed upon the helically extending beads 14. The ends 15' of the beads 14 may also alternatingly extend somewhat farther into the non-deformed regions 16, 17 of the can body 12, as shown by broken lines.

Figure 7:
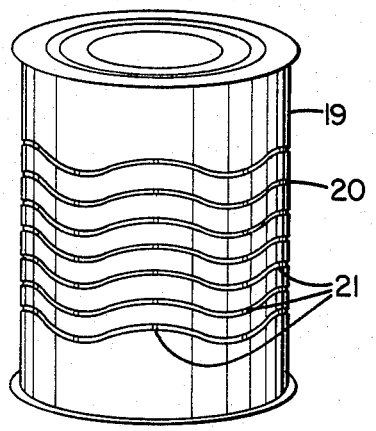
FIG. 7 is a schematic illustration in perspective view of a can body constructed according to the invention containing precision beads extending along wavy or undulated lines.
Figure 9:
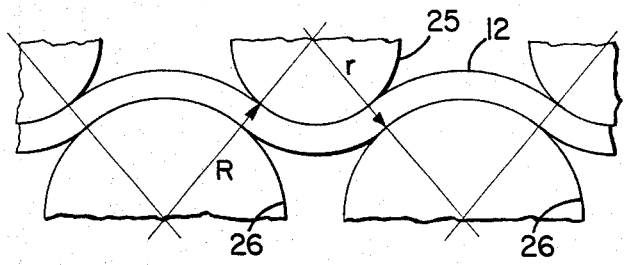
FIG. 9 is a sectional view taken substantially along the line IX—IX in FIG. 8.

According to the can design of FIG. 7, circumferential beads 20 having a cross-section analogous to the beads 10 and 14 described hereinbefore and extending along wavy or undulated lines are embossed into a can body 19. Vertical beads 21 are superimposed on the wavy line or undulatory beads 20.

Preferably, the distance d of the beads 10 (FIGS. 3 to 5), 14 (FIG. 6) and 20 (FIG. 7) is in a range of approximately 2.0 to 3.9 mm with a sheet metal or stock thickness s of 0.15 mm. The depth h of the deformation is in the range of approximately 0.4 to 0.8 mm; the upper values are preferred for doubly-reduced sheet metal or plating while for singly-reduced sheet metal the lower values are more advantageous.

Figure 8:
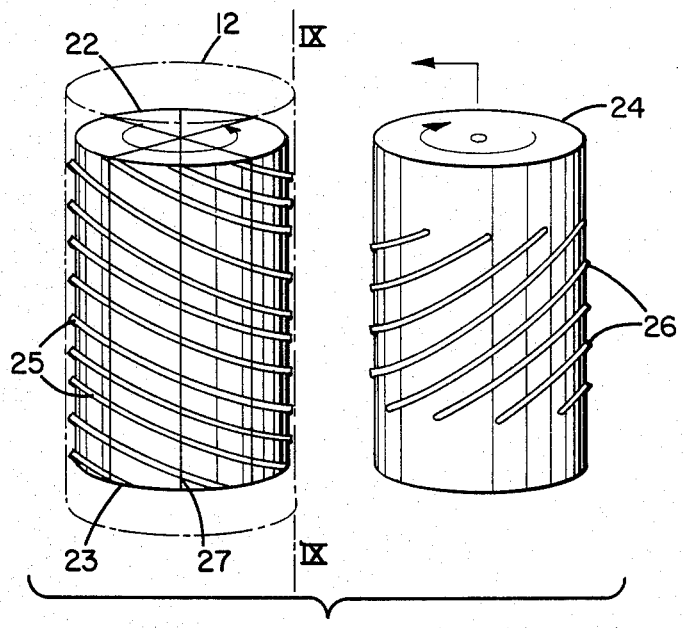
FIG. 8 is a schematic illustration in perspective view of a set of tools suitable for producing helical beads and the vertical beads in the can body shown in FIG. 6.

FIG. 8 shows a coacting set of tools 23 and 24 of an exemplary embodiment of apparatus for producing the helical beads 14 as shown in FIG. 6. Both tools, i.e. the inner tool 23 composed of expandible or spreadable segments 22 and the outer tool 24 which is radially displaceable relative to the inner tool 23, contain ribs 25 and 26, respectively, on their respective cylinder face or outer surface. The ribs 25, 26 constitute fine, extremely precisely formed elevations protuberances including cleanly rounded shoulders.

When the two tools 23 and 24 are driven synchronously and roll-off each other, the ribs 26 of the outer tool 24 come to lie precisely intermediate the ribs 25 of the inner tool 23. Interruptions for forming the axial or vertically extending beads 18 are present in the ribs of the inner tool 23. The interruptions are arranged axially in parallel one above the other at a number of locations and are defined in the illustrated example by the interrupting spaces or distances 27 formed between the individual neighboring segments 22 of the inner tool 23 in the spread state thereof.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for producing fine precision beads in thin-walled cans having a can body made of sheet metal comprising:
   - an inner expansible tool capable of being positioned coaxially relative to the can body;
   - an outer tool arranged substantially axially parallel to said inner tool and capable of rolling upon a can body positioned upon said inner tool in a work position of said tools;
   - substantially parallel circumferential ribs provided at said inner tool and at said outer tool;
   - interruptions disposed at one or more locations of said circumferential ribs on at least one of said inner tool or said outer tool;
   - said interruptions extending substantially parallel to a lengthwise axis of the can body and being positioned above one another; and
   - said circumferential ribs on said inner tool engaging into intermediate spaces between said circumferential ribs on said outer tool in the work position of said tools in which said outer tool is capable of rolling upon the can body positioned upon said inner tool.

2. The apparatus as defined in claim 1, wherein: said circumferential ribs extend at an inclination relative to the horizontal.

3. The apparatus as defined in claim 1, wherein: each of said circumferential ribs extends along a helical line.

4. The apparatus as defined in claim 1, wherein:
   - each of said circumferential ribs extends in an undulatory configuration around the circumference of the related tool.

5. The apparatus as defined in claim 1, wherein: said circumferential ribs have different cross-sections.

6. The apparatus as defined in claim 1, wherein: the radius of said ribs on said outer tool is greater than said radius of said ribs on said inner tool.

7. The apparatus as defined in claim 1, wherein:
   - said expansible inner tool comprises spreadable segments; and
   - said interruptions are formed by the distance between individual neighboring ones of said spreadable segments in the spread state of said expansible inner tool.

* * * * *